US005522557A

United States Patent [19]

Tiggesbaumker et al.

[11] Patent Number: 5,522,557

[45] Date of Patent: Jun. 4, 1996

[54] ROLL MILL

[75] Inventors: Peter Tiggesbaumker, Oelde; Helmut Lucke, Beckum; Reinhold Giesemann, Harsewinkel; Johann Knecht, Wadersloh; Gerhard Blatton, Beckum, all of Germany

[73] Assignee: Krupp Polysius AG, Beckum, Germany

[21] Appl. No.: 245,456

[22] Filed: May 18, 1994

[30] Foreign Application Priority Data

Jun. 22, 1993 [DE] Germany ..... 43 20 668.9

[51] Int. Cl.[6] ..... B02C 4/32

[52] U.S. Cl. ..... 241/37; 241/227; 241/231

[58] Field of Search ..... 241/37, 227, 230, 241/231, 234

[56] References Cited

U.S. PATENT DOCUMENTS 3,845,906 11/1974 Lillig et al. ..... 241/32

3,938,732 2/1976 Schrimper et al. ..... 241/231

4,880,172 11/1989 Heinemann et al. ..... 241/101.2

4,973,001 11/1990 Kastingschafer et al. ..... 241/37

*Primary Examiner*—John Husar

*Attorney, Agent, or Firm*—Learman & McCulloch

[57] ABSTRACT

A roll mill has a fixed roll journalled in stationary fixed bearings and a floating roll journalled in movable bearings enabling the floating roll to be pressed against the fixed roll under high pressure. An adjustable spacing arrangement is provided between the two bearings to enable a gap of selected width to be formed between the rolls. The spacing arrangement includes a pair of shaft-like distance members received and guided in associated bores of the fixed bearings for movement therealong. Free ends of the distance members extend outward of their bores and engage the opposing floating bearings to adjust the positions of the rolls as they wear so as to maintain the selected gap width. The free ends are retractable into the bores to allow the bearings to abut one another and thereby optimize the wear life of the rolls.

15 Claims, 3 Drawing Sheets

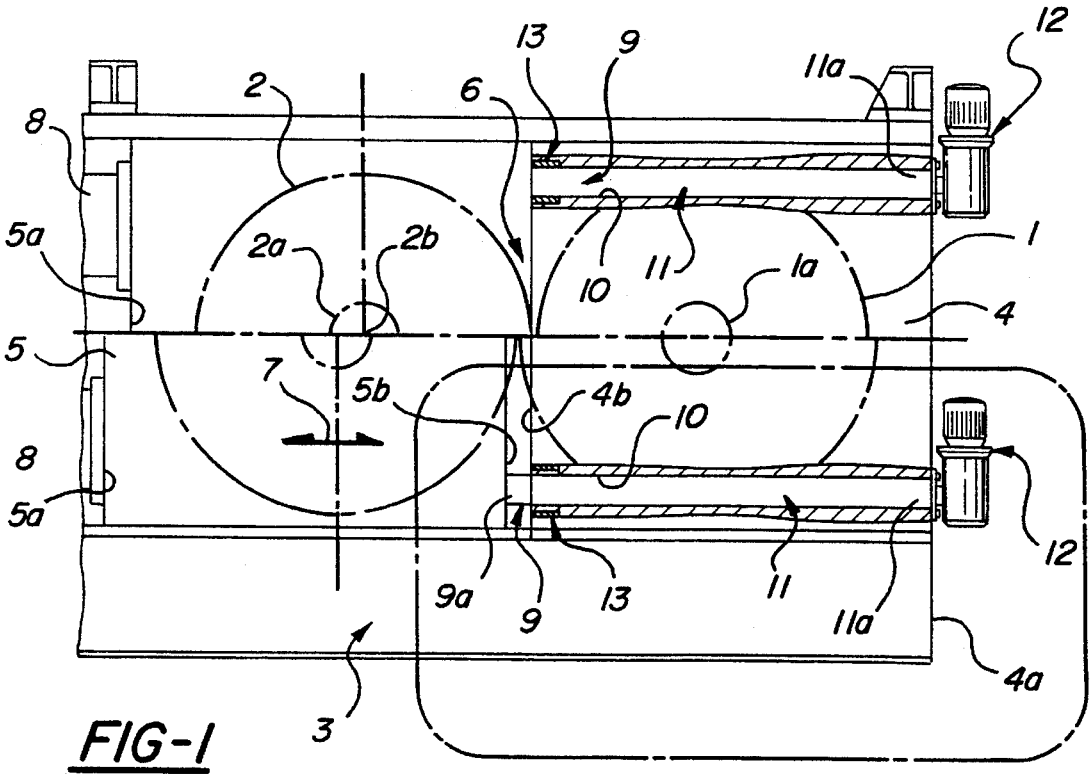
FIG-1
FIG-2
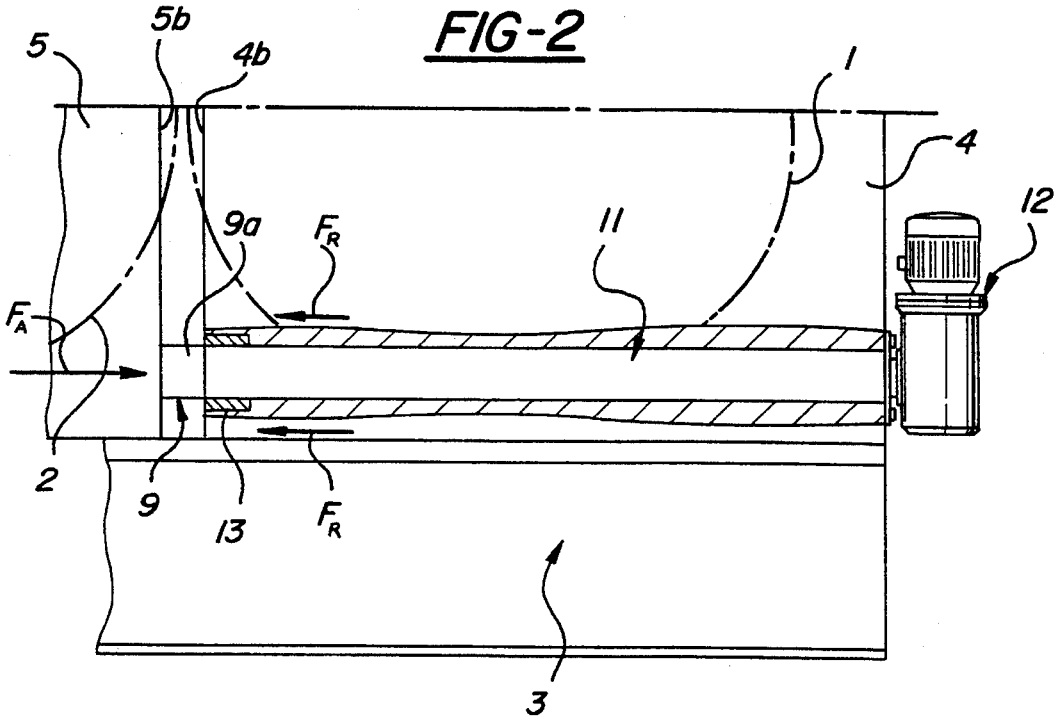

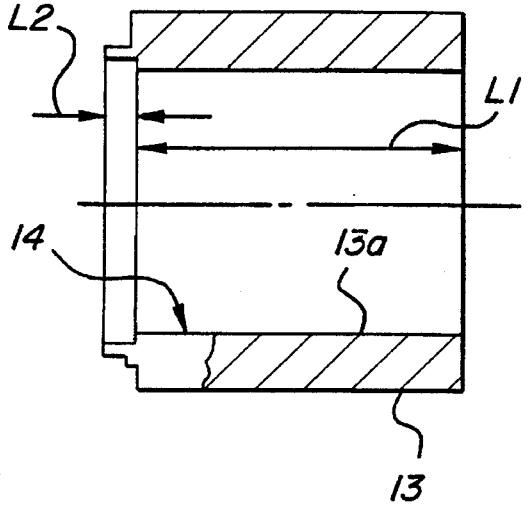
FIG-4
FIG-5
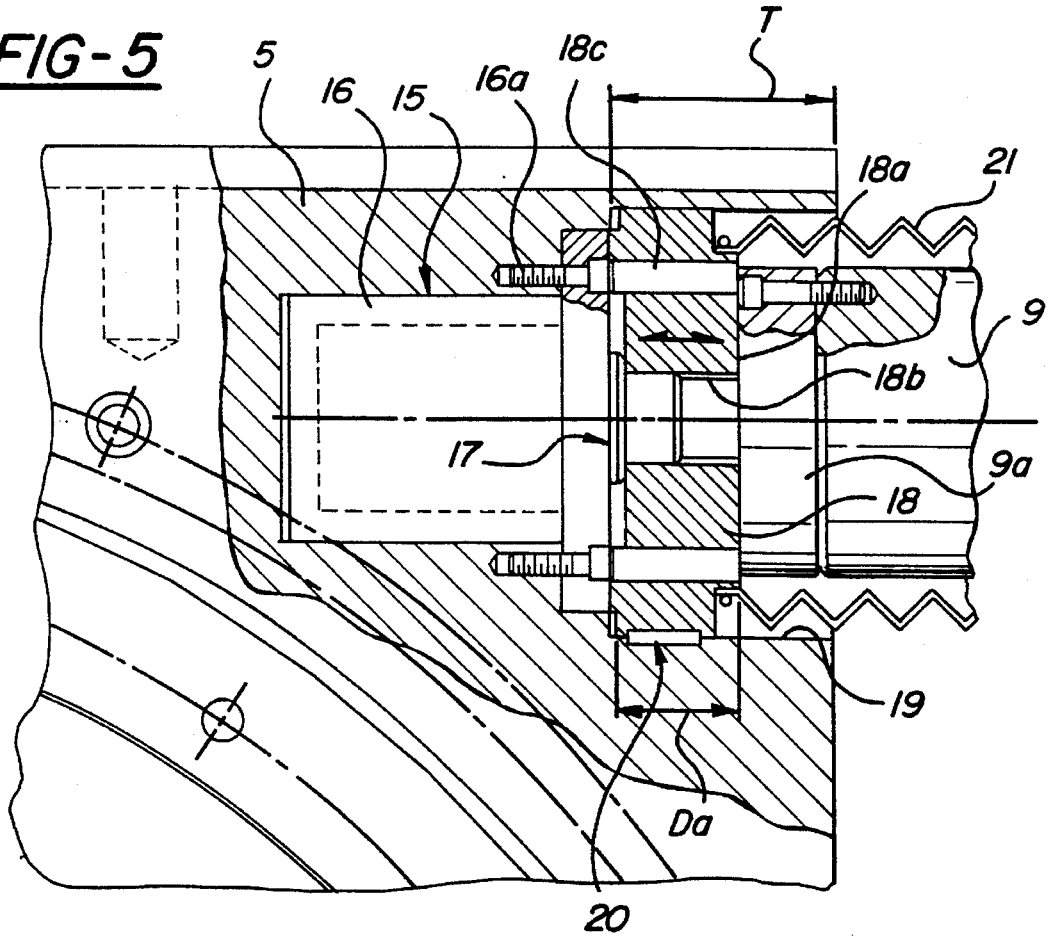

ROLL MILL

The invention relates to a roll mill, particularly a material bed roll mill for comminution of relatively brittle material for grinding.

BACKGROUND OF THE INVENTION

Roll mills, particularly material bed roll mills, are used particularly advantageously for the comminution of mineral material, for example cement raw materials, cement clinker, ores or the like, that is to say relatively brittle and highly abrasive bulk materials. In order during material bed comminution to be able to maintain a predetermined grinding gap between the two rollers and thus above all to maintain a minimum basic gap, distance pieces are generally provided between the adjacent bearing jewels which rotatably support the rolls. As a function of the grinding process wear occurs on the roll surfaces, so that with a fixed setting of the distance pieces the basic grinding gap between the two rolls would become increasingly larger, which has a negative effect on the grinding process. In order to prevent this, adjustable distance pieces are generally provided between the bearing jewels which are adjacent to one another.

In a quite simple known construction of distance pieces, these can be provided for instance in the form of sets of plates or the like, so that these distance pieces can be infinitely adjusted by the removal of plates.

Furthermore, it is also known in the art to construct distancing arrangements in the form of spindle drive arrangements which each comprise an adjusting spindle and a spindle nut and can be infinitely adjusted by turning the spindle or the nut. In this case in the region between two fixed and floating bearing jewels arranged adjacent to one another the spindles can be rotatably mounted with one end on the inner end face of the fixed bearing jewel and can be provided with a drive chain wheel, whilst the opposite end of the spindle is in screwed engagement with a spindle nut arranged on the inner end face of the floating bearing jewel, aided by a separate protection against torsion.

The disadvantages of these known distance piece constructions may be seen above all in the fact that they are arranged essentially between the fixed and floating bearing jewels which are arranged adjacent to one another and that they usually require a relatively large minimum installation space, as a result of which a maximum possible wear path cannot be optimally utilised when the rolls are moved together in order to maintain the grinding gap. Moreover, it is frequently necessary to interrupt the grinding process when the grinding gap is being newly set, so that undesirable shutdown times must be accepted.

Therefore in such a roll mill it is desirable that the distance pieces of the distancing arrangement should satisfy as many as possible of the following requirements:

- in order to be able to utilise fully the maximum possible thickness of the wear layer, the fixed and floating bearing jewels which are arranged adjacent to one another should be able to be moved together until they touch;
- with a view to an optimum grinding process the basic setting (basic gap) of the grinding gap is very important, so that the distance pieces should be infinitely adjustable;
- in order as far as possible to avoid shutdown times, even in the case of roll mills operated in a continuous process, the distance pieces should be adjustable without difficulties from the exterior or automatically by way of their distancing arrangements;
- the distance pieces should not exert any additional tipping moments on the bearing jewels.

SUMMARY OF THE INVENTION

Accordingly the object of the invention is to construct a roll mill in such a way that it satisfies as many as possible or all of the aforementioned requirements and ensures a relatively simple construction of the distancing arrangements, the functional operation of these distancing arrangements being transferrable to all sizes of roll mill. In this case it is also desirable to provide an additional possibility by means of which in the case of worn rolls a rapid and, if required, fully automatic return of the floating roll unit can be achieved.

In the roll mill according to the invention each ram-like distance piece is received so as to be axially movable and is guided in a bearing bore in the appertaining fixed bearing jewel, the length of the bearing bore corresponding at least to the length of the distance piece. Thus since each distance piece can be completely received in the appertaining bearing bore, a particularly advantageous precondition is thereby created so that the fixed and floating bearing jewels which are arranged adjacent to one another can be brought together on each side of the roll bed-frame by continuous adjustment of the distance pieces until they touch one another or butt against one another. In this way the maximum thickness of the wear Layer of the rolls can be fully utilised. These possibilities are also aided particularly favourably by the fact that the end of the or each distance piece which can be moved axially out of the bearing bore is in distanced engagement with a mating surface on the opposing inner end face of the floating bearing jewel, i.e. in the simplest construction the end of the distance piece which can be moved out can act directly against a corresponding surface portion of the opposing inner end face; however, this mating surface on the opposing inner end face of the floating bearing jewel can also be formed by a pressure plate or the like which is countersunk in this end face and can be produced if required from particularly wear-resistant material, but in any case does not prevent these bearing jewels which are arranged adjacent to one another from being moved completely together.

Above all with a view to adjustment of the distancing arrangement or the distance pieces thereof which can be carried out, automatically if required, during the grinding process it is particularly advantageous if each distance piece is the end of a driving spindle facing the appertaining floating bearing jewel, wherein this driving spindle passes through the fixed bearing jewel from its inner end face to its outer end face in the bearing bore and in a through bore which extends this bearing bore, driving elements—which can be driven manually or by motor—for this driving spindle being provided on the said outer end face, and if a spindle nut with which the driving spindle is in screwed or adjusting engagement is arranged in the bearing bore and/or in the through bore so as to be secure against torsion.

So that no additional tipping moments can be applied to the bearing jewels from the distancing arrangements, each fixed bearing jewel is equipped-with two distance pieces lying one above the other which are both of similar construction and are provided with similar driving spindles and driving elements, these two distance pieces lying with their longitudinal central axis in the vertical longitudinal central plane of the bearing jewel (4)—when considering the inner end face (4*b*) of the appertaining fixed bearing jewel (4). Thus if one considers the two fixed bearing jewels, then the two distance pieces which are arranged therein in each case are arranged symmetrically with respect to the vertical longitudinal central plane or plane of symmetry—in the cross direction to the bearing jewel and thus in the axial direction of the rolls—so that no tipping moment can be applied to the bearing jewels even about any line on this longitudinal central plane.

According to a further advantageous embodiment of the invention a return arrangement which is built into the floating bearing jewel from the opposing inner end face is co-ordinated with each distance piece. This return arrangement can be particularly advantageously constructed in the form of a hydraulic cylinder-piston unit. In this way the possibility is created of returning the floating roll unit quickly to its starting position after complete wear of the wear protection layer, i.e. pushing it so far back in the roll bed-frame that it reaches at least the starting position of its state when new and that both rolls are sufficiently readily accessible for reconstruction or for application of a new wear layer.

THE DRAWINGS

The invention will be explained in greater detail below with the aid of several embodiments which are illustrated in the drawings. In these drawings, which have been kept largely schematic:

FIG. 1 shows a side view of the roll mill according to the invention, in which in the upper half of the drawing the fixed bearing jewel and the floating bearing jewel butt against one another, whilst in the lower half of the drawing they are kept at a distance from one another;

FIG. 2 shows a partial view on an enlarged scale corresponding to the detail II in FIG. 1, for explanation of the forces which occur;

FIG. 4 shows a longitudinal sectional view of a spindle nut;

FIG. 5 shows an enlarged detail view (detail V in FIG. 3) for explanation of the return arrangement.

DETAILED DESCRIPTION

Figure 3:
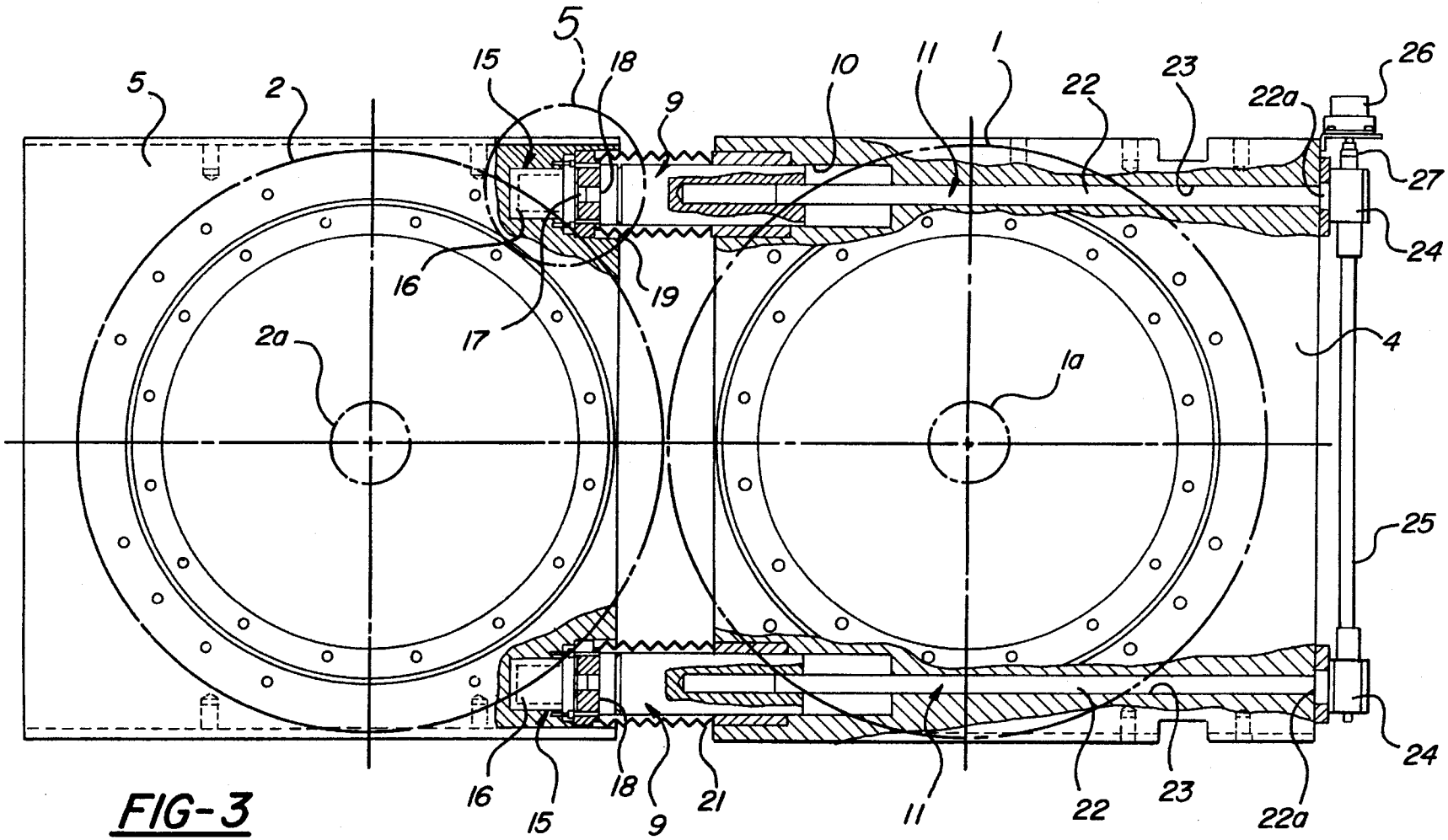
FIG. 3 shows a side view of a second embodiment of the roll mill, in which return arrangements are co-ordinated with the distance pieces.

In the roll mill according to the invention the features of the invention are quite particularly advantageous when it is constructed in the form of a material bed roll mill for the comminution of relatively brittle material for grinding. In the embodiments illustrated in the drawings, therefore, the mill is in each case a material bed roll mill.

In the first embodiment of the roll mill shown in FIGS. 1 and 2 two rolls, namely a fixed roll 1 and a floating roll 2, are assembled in a manner which is known per se in a roll bed-frame 3, one side view of one side or long side of the frame being shown in FIG. 1, whilst the other, opposite side of the frame is of similar construction but in mirror image thereto.

The first roll which is constructed as a fixed roll 1 is rotatably mounted in the usual way at each of its two axial ends by an axle journal la in two fixed bearing blocks or jewels 4 arranged stationary on two sides of the frame, whilst the second roll constructed as a floating roll 2 is also rotatably mounted by way of axle journals 2*a* in two floating bearing blocks or jewels 5 which are movable at right angles to the roll axis 2*b* and are arranged in each case so as to be slidably movable on the opposing sides of the frame. Accordingly FIGS. 1 and 2 show only the one fixed bearing jewel 4 which is supported so as to be stationary by the roll bed-frame 3 and the one floating bearing jewel 5 which is arranged adjacent thereto and guided so as to be slidably movable in the roll bed-frame 3.

Between the two rolls 1, 2 a predetermined grinding gap 6 is maintained by a distancing arrangement which will be explained in greater detail below. The floating roll 2 which is movable in the direction of the double arrow 7 in the roll bed-frame 3 relative to the fixed roll 1 is pressed with a high pressure in the direction of the fixed roll 1 whilst maintaining the grinding gap 6, this high pressure usually being exerted by hydraulic rams 8 acting on the outer end faces 5*a*.

The adjustable distancing arrangement already mentioned above is co-ordinated with the two bearing jewels 4, 5 of each side of the frame and takes the form of a spindle drive arrangement which in the region of the inner end faces 4*b*, 5*b* which lie opposite one another of the two appertaining bearing jewels 4, 5 is in distanced engagement with the floating bearing jewel 5 by means of at least, but preferably two ram-like spacer shafts or distance pieces 9 lying spaced one above the other. If one imagines that one is viewing the inner end face 4*b* of each fixed bearing jewel 4, then the corresponding vertical line of symmetry determines a vertical longitudinal central plane or plane of symmetry. Accordingly, with two distance pieces 9 arranged spaced one above the other the geometric longitudinal central axes of these distance pieces 9 lie in the said vertical longitudinal central plane of each fixed bearing jewel 4. This has the advantage that no tipping moment can be applied to the bearing jewels about this longitudinal central plane or vertical plane of symmetry <viewed in the cross-direction to the bearing jewel, that is to say perpendicular to the drawing plane of FIG. 1).

In this roll mill according to the invention each distance piece 9 is received and guided in the appertaining fixed bearing jewel 4 in a bearing bore 10 so as to be axially movable, the length of this bearing bore 10 corresponding at least to the length of the distance piece 9. In this case the end 9*a* of the distance piece 9 which can be moved axially out of the bearing bore 10 is in distanced engagement with a mating surface on the opposing inner end face 5*b* of the floating bearing jewel 5, i.e. so long as the two bearing jewels 4 and 5 must be kept a clear distance apart determined by the grinding gap 6 (cf. FIG. 1, lower half, as well as FIG. 2) the end face of each end 9*a* of a distance piece is pressed against the opposing surface of the inner end face 5*b* of the floating bearing jewel 5.

As can be seen in FIGS. 1 and 2, each distance piece 9 is formed by the end of a driving spindle 11 which faces the appertaining floating bearing jewel 5 and which in the present example can have a constant diameter substantially over its entire length and passes through the fixed bearing jewel 4 from the inner end face 4*b* to the outer end face 4*a* thereof in the bearing bore 10 and in a through bore which extends this bearing bore 10. Accordingly in the present example the bearing bore 10 and the through bore which extends it can be constructed so as to be continuous with the same internal diameter. The outer end 11*a* of each driving spindle 11 projecting out of the outer end face 4*a* of the appertaining fixed bearing jewel 4 is connected for driving in rotation to driving elements which in the present case can each be constructed overall as servomotors (geared motor units) 12. Naturally, in the simplest of all constructions or in case of need it is basically also possible to provide driving elements which can be be operated manually. The servomotors 12 are advantageously built onto the outer end faces 4*a* of the fixed bearing jewels 4, which can be achieved for example in the form of slip-on drive motors (as shown) or also by geared motor units arranged on corresponding brackets.

In the bearing bore 10 and/or in the through bore which extends this bearing bore a spindle nut 13 is arranged so as to be secure against torsion and the driving spindle 11 is in threaded engagement with this spindle nut in order to be able to displace the distance piece 9 of each driving spindle 11 axially more or less far relative to the inner end face 5*b* of the floating bearing jewel 5.

In this first embodiment (FIGS. 1 and 2) at least the end portion of each driving spindle 11 which forms the distance piece 9 is provided with a suitable outer thread which is in threaded engagement with an internal thread constructed in the spindle nut bore. The spindle nut 13 is advantageously built into the bearing bore 10 from the inner end face 5*b* of the fixed bearing jewel 5 so that it does not project with respect to this inner end face 5*b*.

An example of such a spindle nut 13 is shown in FIG. 4. According to this the bore 13*a* of this spindle nut 13 has an internally threaded longitudinal portion L1 which is in engagement with the external thread of the distance piece 9 as well as a—preferably markedly shorter—longitudinal sliding guide portion L2 which is adapted to the external thread diameter of the distance piece 9. By this means the weight of the spindle can be taken up slidably by the longitudinal sliding guide portion L2, whilst the internal thread 14 is substantially relieved of weight and is available only for the axial adjustment of the appertaining distance piece 9.

This internal thread 14 of the spindle nut 13 as well as the external thread co-operating therewith on each distance piece 9 can be constructed for example in the form of a buttress thread, as is indicated to some extent in FIG. 4 in a detail sectional view. In this way a particularly reliable axial support of the distance piece 9 is ensured.

Furthermore, in the enlarged detail view of FIG. 2 the force coming from the floating bearing jewel 5 is indicated by the arrow $F_A$, this force being introduced directly by way of the spindle nut 13 into the fixed bearing jewel 4, as indicated by the force of reaction represented by the arrows $F_R$. By this construction the driving elements or servomotors 12 for the driving spindles 11 are not loaded by the force of reaction $F_R$, so that an easy adjustability of the distance pieces 9 is ensured.

A further embodiment is explained below with the aid of FIGS. 3 and 5. In this case too the fixed roll 1 and the floating roll 2 are rotatably mounted by way of their axle journals 1*a* and 2*a* respectively in basically the same way in fixed bearing jewels 4 or floating bearing jewels 5 respectively, in the same way as in the first embodiment. Therefore all similar components of this second example (FIGS. 3 and 5) are provided with the same reference numerals, so that a repeated detailed explanation of these components is largely superfluous.

A first essential difference between this second embodiment and the first embodiment may be seen first of all in the fact that a return arrangement 15 built into the appertaining floating bearing jewel 5 from the opposing inner end face 5*b* is co-ordinated with each distance piece 9. This return arrangement is in each case preferably constructed in the form of a hydraulic cylinder-piston unit 15, the cylinder 16 of which is arranged fixed in a cylindrical bore in the floating bearing jewel 5; for example each cylinder 16 can be fixed in the floating bearing jewel 5 with the aid of screws 16*a* so as to be releasable or replaceable. The piston rod 17 of each cylinder 16 bears on its free end a pressure plate 18 which—as indicated in FIG. 5—is fixed by way of a central threaded bore 18*b* on the piston rod 17 so as to be replaceable and has cylindrical through bores 18*c* in its outer peripheral region in such a way that these through bores 18*c* serve to a certain extent as a passage for the fixing screws 16*a* of the cylinder 16. This pressure plate 18 is received so as to be secure against torsion in a recess 19 which opens to the inner end face 5*b* of this floating bearing jewel 5, but is guided so as to be axially slidably movable, and an adjusting spring 20 can for example be provided for this purpose as the element for securing it against torsion. The outer end surface 18*a* of this pressure plate 18 forms the mating surface for the appertaining distance piece 9. As can be seen particularly in FIG. 5, the depth T of this recess 19 is greater than the axial thickness Da of this pressure plate 18. In this case it is advantageous if the end of the pressure plate 18 which is directed axially outwards and the end of the distance piece 9 which is in each case moved out of the bearing bore 10 in the floating bearing jewel 4 is surrounded by a common bellows 21 which when closed up—as can be readily perceived from FIGS. 3 and 5—can be accommodated in the recess 19 so that no hindrance is produced thereby for the bearing jewels 4 and 5 to be moved completely towards one another. As can also be seen from the representation in FIG. 5, in this case it can be advantageous for the outer end of each distance piece 9 which is in distanced engagement with the pressure plate 18 to be constructed as a hardened plate part 9*a*' which can preferably be produced separately and releasably fixed, preferably screwed, on the actual distance piece 9. As a result only the outermost end of each distance piece 9 which comes into engagement with the pressure plate 18 needs to be correspondingly hardened, whilst the greater remaining part can be produced from adapted simple material.

Although the actual spindle drive arrangement in this second embodiment (FIGS. 3 and 5) could basically be of similar construction to that described with the aid of FIGS. 1 and 2, it may be assumed that—according to the representation in FIG. 3—each driving spindle 11' is formed on the one hand again by the distance piece 9 provided with the external thread and on the other hand by a spindle shaft 22 which is smaller in diameter and constructed without a thread (smooth), the outer end 22*a* of which is connected to the driving elements. In this case each bearing bore 10 is then extended by a through bore 23 which directly adjoins it coaxially and the internal diameter of which can be markedly smaller than that of the bearing bore 10 and is correspondingly adapted to the diameter of the spindle shaft 22.

Also in this second embodiment each fixed bearing jewel 4 is again equipped with two distance pieces 9 which lie an appropriate distance apart above one another, substantially according to the first example.

Moreover, according to the representation in FIG. 3, for each driving spindle 11' of a fixed bearing jewel 4 a gear 24 is arranged on the outer end face 4*a*, both gears 24 being connected to one another for driving in rotation by means a resilient drive shaft 25. In this case a common rotary drive which can be constructed as an electric servomotor or—preferably—as a hydraulic servomotor or hydraulic drive 26 and is preferably connected to one gear 24 by a resilient coupling is co-ordinated with both gears 24.

In this way both distance pieces of a fixed bearing jewel 4 can be jointly or synchronously adjusted relative to the inner end face 5*b* of the appertaining floating bearing jewel 5. Furthermore, in case of need a portion of the drive shaft 25 can be provided with a polygonal cross-section in such a way that the possibility exists of providing for a manual drive of this spindle drive arrangement with the aid for example of a suitable screw spanner.

We claim:

1. A roll mill construction comprising:

a frame;

a fixed roll;

a floating roll;

first bearing means journalling said fixed roll on said frame for rotation in one direction relative to said frame;

second bearing means journaling said floating roll for rotation in the opposite direction relative to said frame and supported slidably by said frame to enable displacement of said floating roll toward and away from said fixed roll to provide a gap between said rolls, said first and second bearing means having opposing faces;

pressing means acting on said second bearing means for urging said floating roller under high pressure toward said fixed roller to crush material in said gap; and adjustable spacer means acting between said first and second bearing means in opposition to said pressing means for adjusting the relative positions of said faces to maintain a predetermined minimum width of said gap as said rolls wear and enabling said faces to abut one another to define a maximum wear condition of said rolls.

2. The construction of claim 1 wherein said adjustable spacer means comprises at least one bore in one of said bearing means extending inwardly from the face thereof and an associated shaft within said bore having a free end extendible outward of said bore for engaging said opposing face of the other bearing means to adjust the spacing between said faces, said free end of said shaft being retractable into said bore to vary the spacing between said faces.

3. The construction of claim 3 wherein said bore is provided in said first bearing means.

4. The construction of claim 3 including a nut fixed in said bore and threadably engaging said shaft.

5. The construction of claim 4 wherein said nut is axially spaced from said face of said first bearing means.

6. The construction of claim 4 including drive means coupled to said shaft for rotating said shaft within said bore.

7. The construction of claim 6 wherein said shaft includes a distance piece portion having external threads engaging threads of said nut and a relatively smaller diameter spindle portion of said shaft coupled to said drive means.

8. The construction of claim 6 wherein said adjustable spacer means comprises a pair of said bores and an associated pair of said shafts.

9. The construction of claim 8 wherein said drive means comprises drive gears coupled to said shafts and a flexible coupling interconnecting said gears to synchronize the rotation of said shafts.

10. The construction of claim 3 wherein said second bearing means includes shaft return means engaging said free end of said shaft operable to bias said shaft toward its retracted condition.

11. The construction of claim 10 wherein said return means comprises a piston bore extending into said face of said second bearing means coaxial with said shaft bore and a piston accommodated within said piston bore.

12. The construction of claim 11 wherein said piston includes a pressure plate carried by of said piston and having a predetermined thickness, said piston bore including an enlarged stepped recess portion having a predetermined depth and accommodating said pressure plate, said depth of said recess portion being greater than said thickness of said pressure plate.

13. The construction of claim 12 including a bellows seal enclosing said free end of said shaft and said free end of said pressure plate.

14. The construction of claim 1 wherein said shaft includes a hardened metal end section presenting said free end of said shaft and secured releasably to a remaining portion of said shaft.

15. A roll mill construction comprising:

a frame;

a pair of rolls;

a pair of fixed bearing blocks mounted on said frame at opposite ends of one of said rolls journaling said one of said rolls for rotation in one direction about its axis and securing said one of said rolls against displacement relative to said frame;

a pair of floating bearing blocks mounted slidably on said frame at opposite ends of the other of said rolls journalling said other of said rolls for rotation in the opposite direction about its axis and supporting said other of said rolls for displacement relative to said frame toward and away from said one of said rolls to provide a variable width gap therebetween;

a roll press acting forcibly on said floating bearing blocks to urge said other of said rolls with high pressure toward said one roll to crush material in said gap; and a pair of telescoping spacer shafts supported within associated shaft bores of said fixed bearing blocks and arranged one above the other intermediate said ends of said rolls, said shafts having free ends extendible outward of said bores and engagable with respective ones of said floating bearing blocks for adjusting the relative positioning of said fixed and floating bearing blocks to vary the width of said gap as said rolls wear, said free ends of said shafts being retractable into said bores thereby enabling said floating bearing blocks to abut said fixed bearing blocks and define a maximum wear condition of said rolls.

* * * * *